US006224307B1

(12) United States Patent
Johnson et al.

(10) Patent No.: US 6,224,307 B1
(45) Date of Patent: May 1, 2001

(54) BRACING MECHANISM AND METHOD FOR SECURING LOADING PLATFORMS

(75) Inventors: Charles L. Johnson, Huntsville; Harold L. Smith, Harvest; Robson Slater, Union Grove, all of AL (US)

(73) Assignee: Summa Technology, Inc., Huntsville, AL (US)

( * ) Notice: Subject to any disclaimer, the term of this patent is extended or adjusted under 35 U.S.C. 154(b) by 0 days.

(21) Appl. No.: 09/410,884

(22) Filed: Oct. 4, 1999

(51) Int. Cl.[7] ..... B60P 1/64; B63B 25/00
(52) U.S. Cl. ..... 410/89; 410/26; 410/132
(58) Field of Search ..... 410/24, 26, 77, 410/84, 89, 132, 142; 414/812

(56) References Cited

U.S. PATENT DOCUMENTS 2,498,146 * 2/1950 Trotter .
3,776,169 * 12/1973 Strecker .
3,938,678 * 2/1976 Kern .
3,980,185 * 9/1976 Cain .
4,068,813 * 1/1978 Chatwin et al. .
4,130,075 * 12/1978 Larive .
4,231,695 * 11/1980 Weston, Sr. .
4,611,962 * 9/1986 Braly et al. .
4,834,000 * 5/1989 Darnell et al. .
4,984,962 * 1/1991 Jarvinen .
5,775,858 * 7/1998 Bacon .
5,799,585 * 9/1998 Brennan, Jr. et al. .
5,906,165 * 5/1999 McCorkle, Jr. et al. .
5,983,806 * 11/1999 Brennan, Jr. et al. .
6,027,291 * 2/2000 Sain et al. .

* cited by examiner

*Primary Examiner*—D. Glenn Dayoan
*Assistant Examiner*—Scott Carpenter
(74) *Attorney, Agent, or Firm*—Lanier Ford Shaver & Payne P.C.; David L. Berdan

(57) ABSTRACT

The present invention is directed to an apparatus and method for securing loads in transportation shipping containers. The bracing mechanism of the present invention is particularly well suited for use in combination with loading platforms such as CROPs to secure the CROP against at least forward movement within shipping containers. The bracing mechanism of the present invention preferably includes a cam assembly that is sized and shaped to mate with the existing shoring slots defined in the interior walls of the shipping container, and an elongated traversing mechanism that provides infite adjustability over the length of the traversing mechanism. A method of bracing a loading platform such as a CROP within an ISO shipping container is also disclosed.

12 Claims, 8 Drawing Sheets

BRACING MECHANISM AND METHOD FOR SECURING LOADING PLATFORMS

STATEMENT OF GOVERNMENT RIGHTS

This invention was made with government support under contract DAAE07-96-C-X083 and contract DAAE07-97-C-X110, both awarded by the United States Army Tank-Automotive and Armaments Command. The government has certain rights in this invention.

BACKGROUND OF INVENTION

1. Field of Invention

The present invention relates generally to the field of apparatus and methods for securing loading platforms, and more particularly to a bracing mechanism and method for securing loading platforms within shipping containers without the use of dunnage or complex tie down systems.

While the present invention is subject to a wide range of load securing applications, it is particularly well suited for securing loading platforms within International Standards Organization (ISO) shipping containers.

2. Technical Background

Shipping containers, and specifically ISO containers, have long been a standard vehicle for transporting equipment and other goods via air, land, sea, and rail. These containers are durable, rugged in construction, and are sized and shaped such that they are readily and economically securable to rail cars, trucks, ship holds, and cargo bay floors of large aircraft. Sufficiently bracing loads within these containers, however, has proved to be a challenging task.

In view of these load bracing issues, the United States Armed Services is moving toward the employment of a Container Roll-in/out Platform (CROP) as the load/unload platform for equipment and other goods carried in ISO containers. The M3 and M3A1 CROP each has a flat cargo body with a folding front end structure assembly designed for use with the Palletized Load System (PLS) truck and trailer. Each is designed to be loaded onto the PLS truck and trailer and into an ISO container using the Load Handling System (LHS). Each is also capable, however, of being transported by other modes of transportation through the supply distribution system in a stand-alone configuration.

A standard M3 CROP weighs approximately 3,800 pounds, while a standard M3 A1 CROP weighs approximately 4,000 pounds. The M3 CROP and the M3A1 CROP will accommodate payloads of approximately 32,450 pounds and 32,250 pounds, respectively, when loaded in an ISO container. Loaded CROPs are subjected to numerous forces during transportation, and despite their heavy weight, are often predisposed to shifting during transportation. The shifting, if unaddressed, results in loosening of the loads, which in turn results in damage to the loads, and can also result in damage to the CROP and ISO container as well. Accordingly, repeated contact between the CROP and ISO container can necessitate the replacement of these devices well before the normal end of their useful life.

In the past, shifting has been addressed in a number of ways. A common, albeit, time consuming method of securing loads and loading platforms such as CROPs within ISO shipping containers has been the use of dunnage both during and after loading. Typically, the loading platform is configured with the desired load and then loaded into the ISO container. Dunnage is thereafter positioned around the load and loading platform to secure the cargo against movement within the ISO container. Unfortunately, the random size, shape, and configuration of the various loads necessitates a variety of dunnage materials. Such dunnage occupies a great deal of storage space, has a limited useful life, and becomes costly to replace over time. Moreover, in forward battle areas, these materials are seldom available. In addition, common dunnage materials frequently are insufficiently rigid and/or resilient to adequately support the heavy loads within the ISO containers during extended distance deliveries. The uploading and off loading of the ISO shipping containers, as well as routine handling of the ISO containers causes the load to bear upon the dunnage, which over time, tends to deform, compact and/or dislodge the dunnage, which results in shifting loads. Continued motion causes larger shifts in the loads, which in turn results in damage to the load, loading platform, and/or the ISO container.

Attempts have recently been made to equip the loading platforms themselves with a locking mechanism designed to engage the inner walls of ISO containers to prevent movement of the platforms with respect to the containers. One such transport lock is welded to the front side or sides of the loading platform and is equipped with a plurality of shim plates. The shim plates are stacked horizontally with respect to the front side of the platform within a generally rectangular housing, and can be independently extended laterally of the housing and secured in an extended position. Once the loading platform has been completely loaded into the ISO container, the shim that is most closely aligned with the shoring slot on the interior of the ISO container is extended and locked into the slot in an attempt to prevent at least forward movement (i.e., movement in the direction of the ISO container doors) within the ISO container. Because there are no standards that require specific positioning of the ISO container shoring slots, the shims must be sufficiently slender to facilitate alignment with the slot. Thus, even when the shim is locked into engagement with the shoring slot, some amount of platform movement is permitted by the gap existing between the shim and the shoring slot. Additionally, if the shim is weak, this shifting may cause the shim to snap resulting in failure of the bracing. Moreover, on some occasions, multiple attempts at finally positioning the loading platform within the ISO container are needed to allow one of the plurality of shims to align with the shoring slot.

In view of the foregoing, there is a need for an apparatus and method for securing loading platforms, and thus the loads configured thereon, which obviates the shortcomings of other devices and methods currently know in the art. More specifically, there is a need for a bracing mechanism and method that mounts securely to existing loading platforms such as CROPs, and that securely engages the shoring slots of shipping containers such as ISO shipping containers. The bracing mechanism should have a finite length, but be infinitely adjustable over that finite length. Such a device should be simple to use, inexpensive to manufacture and maintain, readily attachable and detachable from existing equipment, and easy to transport and store when not in use. It is to the provision of such a device and method that the present invention is primarily directed.

SUMMARY OF INVENTION

One aspect of the present invention relates to an apparatus for securing a loading platform to a transport device. The apparatus includes a mounting block connected to the loading platform, a traversing mechanism coupled at one of its ends to the mounting block and having a finite length, and a locking device. The locking device is mounted adjacent the end of the traversing mechanism remote from the mounting block. The locking device is constructed and arranged to selectively engage the transport device and is infinitely adjustable laterally of the mounting block over at least a portion of the traversing mechanism length.

In another aspect, the present invention is directed to a method of bracing a loading platform in a shipping container. The method includes the steps of securing a mounting block having a passageway on the loading platform, inserting a first end of a traversing mechanism axially into the passageway, and mounting a locking device on a second end of the traversing mechanism. The locking device is movable between a stowed position and a position of use, and the method further includes the steps of moving the traversing mechanism axially with the locking device in the stowed position to properly position the locking device with respect to the shipping container, and further, urging the locking device into a position of use whereby the locking device engages the shipping container to prevent at least forward movement (i.e., movement in the direction of the shipping container doors) of the loading platform with respect to the shipping container. In certain embodiments, rearward movement can be limited as well.

An additional aspect of the present invention relates to a method of bracing a loading platform for shipment. The method includes the steps of moving a locking device depending from a traversing mechanism of a bracing mechanism mounted on the loading platform to a stowed position. The traversing mechanism has a finite length and is infinitely adjustable over at least a portion of that length. The method further includes the steps of urging the loading platform into a shipping container having at least one shoring slot, adjusting the traversing mechanism to align the locking device with the shoring slot, and extending the locking device to a position of use such that the locking device mates with the shoring slot.

The bracing mechanism and method of the present invention results in a number of advantages over other devices and methods known in the art. For example, the bracing mechanism of the present invention provides infinite adjustability over at least a portion of the length of its novel traversing mechanism. Accordingly, the bracing mechanism of the present invention can be quickly adjusted to properly mate with the shoring slots of a variety of shipping containers manufactured by various manufacturers. In addition, this infinite adjustability enables the locking device of the bracing mechanism of the present invention to have sufficient thickness to support the shifting loads placed upon it during transportation.

Additionally, the bracing mechanism and method of the present invention enables a user to quickly unload loading platforms such as CROPs from shipping containers such as ISO shipping containers within the five minute download time requirement set by the United States Armed Forces, and desired by others. In a preferred embodiment, the bracing mechanism of the present invention is simply loosened and the locking device rotated out of engagement from the shipping container shoring slot to unsecure the loading platform. Thereafter, the loading platform can be easily withdrawn from the shipping container. Accordingly, the time consuming dunnage removal step frequently associated with standard unloading procedures can be eliminated. Moreover, the bracing mechanism of the present invention can be maintained on the loading platform in a stowed position which enables the loading platform to be quickly reused during shipping operations. At the same time, the bracing mechanism can be easily removed from the loading platform so that it can be stored with a PLS truck or other vehicle for use at a later time.

Additional features and advantages of the invention will be set forth in the detailed description which follows, and in part will be readily apparent to those skilled in the art from that description or recognized by practicing the invention as described herein.

It is to be understood that both the foregoing general description and the following detailed description are merely exemplary of the invention, and are intended to provide an overview or framework for understanding the nature and character of the invention as it is claimed. The accompanying drawings are included to provide further understanding of the invention, illustrate various embodiments of the invention, and together with the description serve to explain the principles and operation of the invention.

DETAILED DESCRIPTION OF THE PREFERRED EMBODIMENTS

Figure 1:
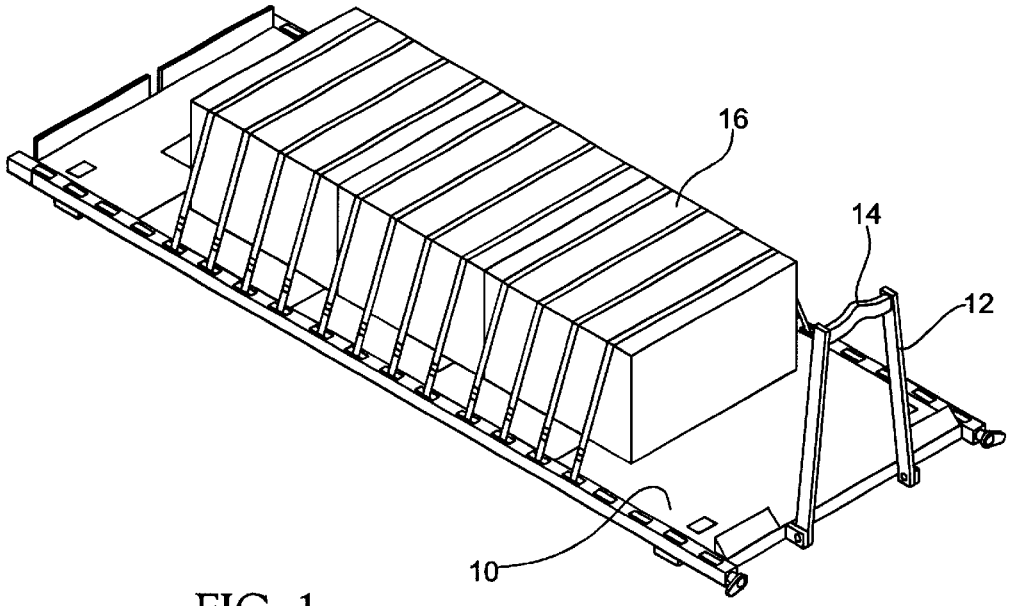
FIG. 1 is a perspective view of an M3 CROP shown in a loaded configuration.
Figure 2:
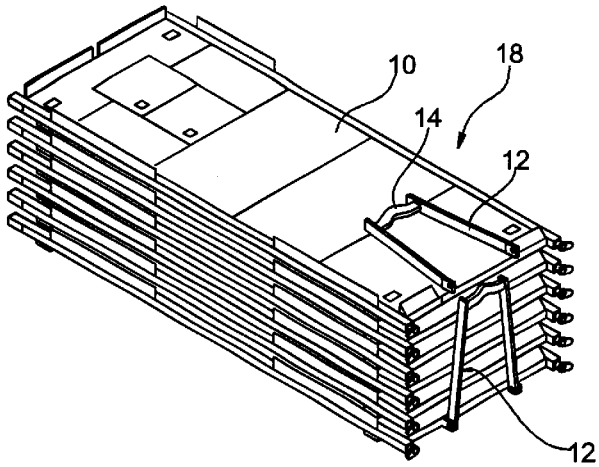
FIG. 2 is a perspective view of a plurality of M3 CROPs shown stacked in retrograde configuration.

The invention will now be described with reference to its preferred use. In this regard, FIG. 1 depicts a standard Container Roll-in/Out Platform (CROP) 10 having an A-frame 12 and a bail bar 14, and is shown configured with a load 16. More specifically, CROP 10 is a flat cargo body having a pivotal A-frame 12, which is designed for use with the Palletized Load System (PLS) truck and trailer. The M3 CROP has a service life of approximately 20 years and is particularly well suited for military application. CROP 10 can be configured with a variety of loads, or it can be configured for shipment in a stacked, retrograde configuration 18 as shown in FIG. 2. When so configured, A-frame 12 of lower most CROP 10 is preferably in an upright position, and the remainder of A-frames 12 are pivoted downwardly to a horizontal or stowed position. Whether configured for loads as shown in FIG. 1, or in retrograde configuration 18 as shown in FIG. 2, A-frame 12, and specifically bail bar 14 of upright A-frame 12 serves as the manipulation bracket for the PLS truck as will be further described with reference to FIG. 3 below.

Figure 3:
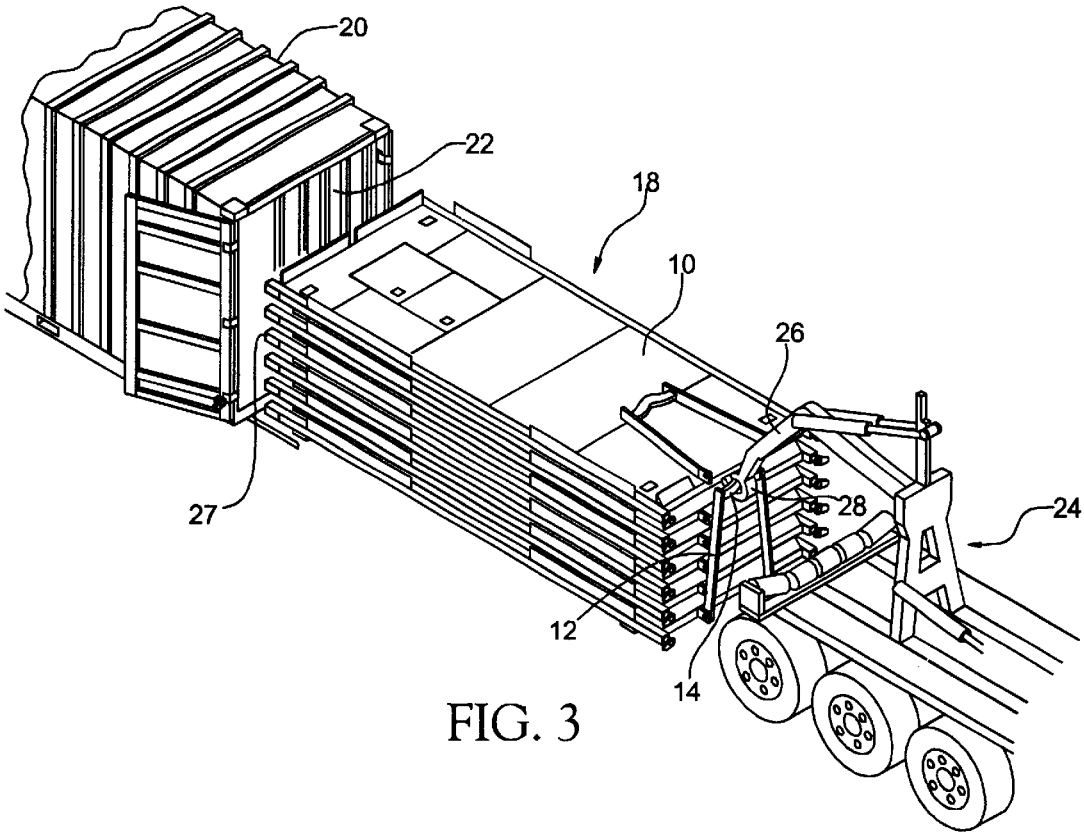
FIG. 3 is a perspective view of a PLS truck shown loading the plurality of CROPs of FIG. 2 into an ISO container.
Figure 4:
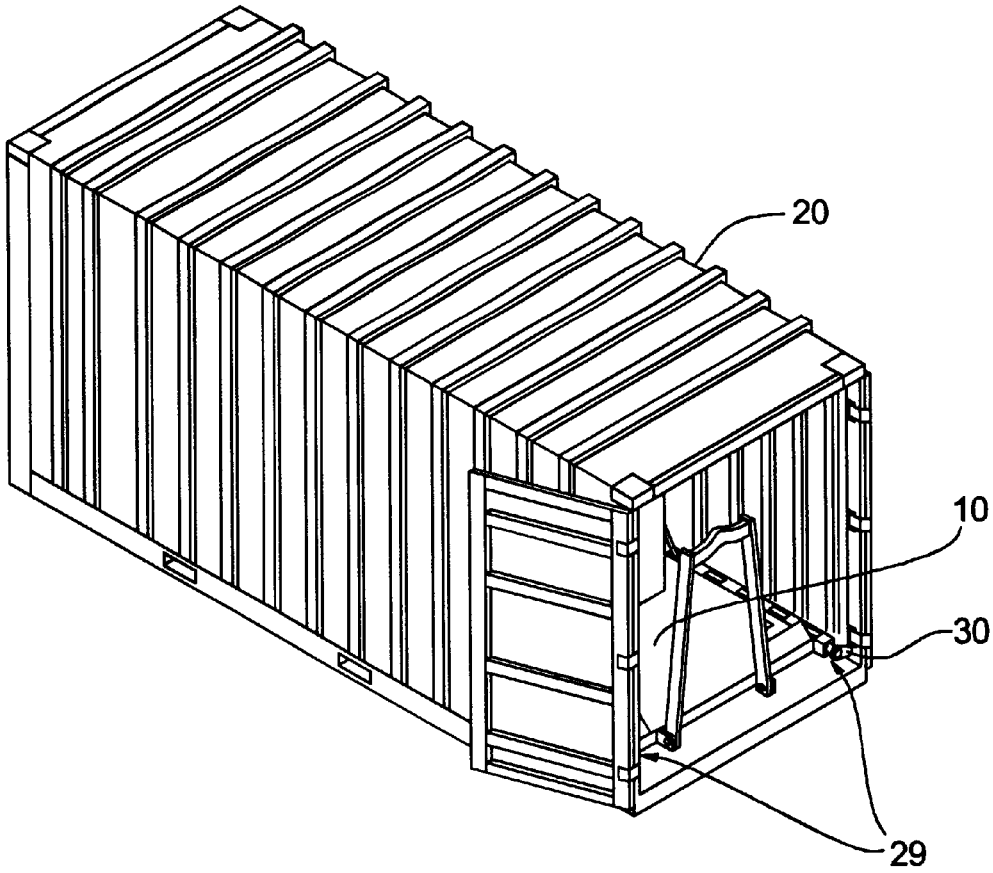
FIG. 4 is a perspective view of an M3 CROP positioned within an ISO container depicting the position of the bracing mechanism of the present invention.

As shown in FIG. 3, the plurality of CROPs 10 in retrograde configuration 18 are positioned in front of an adjacent ISO container 20, having a storage compartment 22 therein, by PLS truck 24. A loading hook arm 26 having an existing hook 28 is used to engage bail bar 14 to facilitate movement of retrograde configuration 18 of CROPs 10. As shown if FIG. 3, rear 27 of retrograde configuration 18 is slowly maneuvered into storage compartment 22 of ISO container 20 by PLS truck 24, and specifically by loading hook arm 26. Each CROP 10 typically includes a plurality of rollers (not shown), which facilitate movement of retrograde configuration 18 or other load (not shown), but could include skids or other devices in lieu of rollers. During loading operations, PLS truck 24 continues to move rearward, thereby facilitating insertion of retrograde configuration 18 into ISO container 20. When complete, retrograde configuration 18, CROP 10 carrying load 16, or as shown in FIG. 4, CROP 10 alone is fully inserted into storage compartment 22 of ISO container 20.

Wile the foregoing detailed description has been set forth with reference to a standard M3 CROP, NSS 3990-01-442-2751, it will be understood by those skilled in the art that the present invention is applicable for use with a standard M3A1 CROP, NSN 3990-01-450-5671, and other loading platforms, as well. Further details relating to both the M3 CROP, and the M3A1 CROP, to include loading and unloading procedures of each using the Load Handling Systems (LHS) can be found in TM 9-3990-260-14 & P, *Operators, Unit, Direct Support and General Support Maintenance Manual* (*Including Repair Parts and Special Tools List*), Headquarters, Department of the Army, Wash., D.C. (Jul. 1, 1999), which is hereby incorporated by reference herein, in its entirety.

Reference will now be made in detail to the present preferred embodiments of the invention, examples of which are illustrated in the accompanying drawings. Wherever possible, the same reference numerals will be used throughout the drawing figures to refer to the same or like parts. An exemplary embodiment of the bracing mechanism of the present invention is positioned with respect to CROP 10 and ISO container 20 as indicated in FIG. 4 by reference numeral 29, and is designated generally throughout by reference numeral 30.

Figure 5:
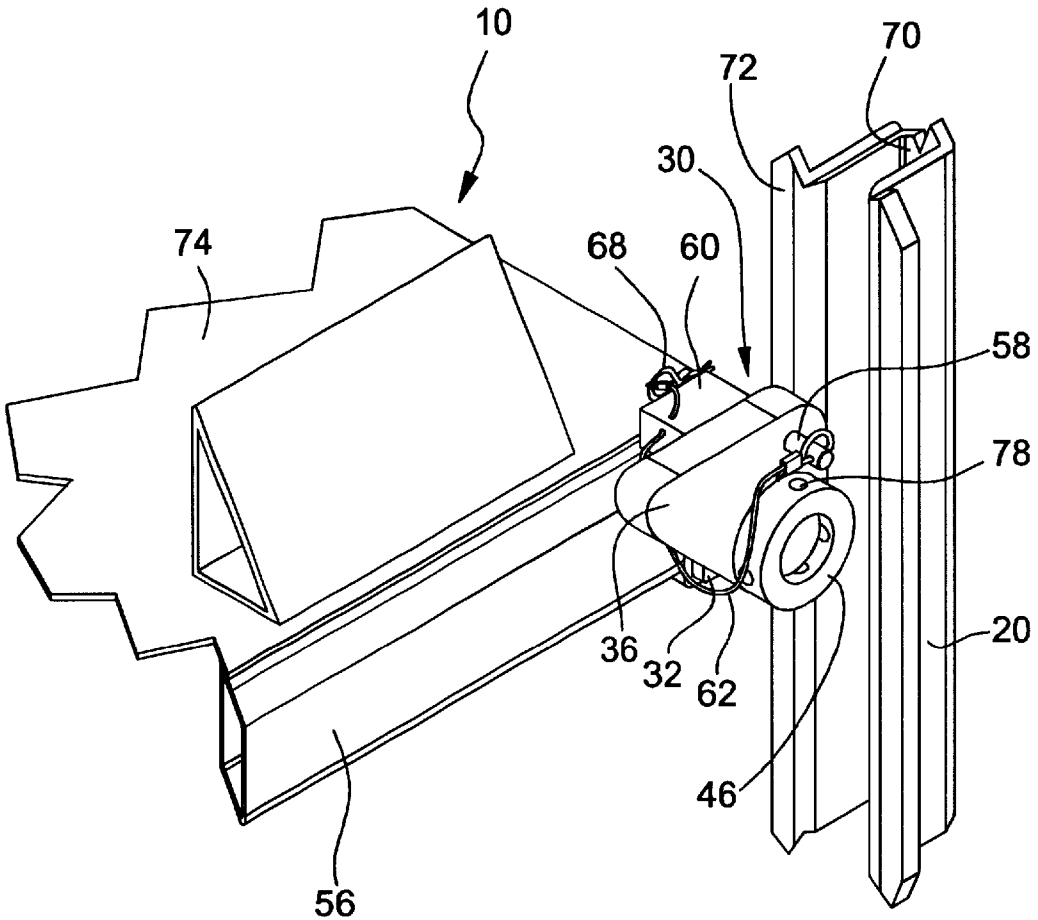
FIG. 5 is an enlarged partial perspective view of FIG. 4 depicting the preferred bracing mechanism of the present invention in a stowed configuration.
Figure 6:
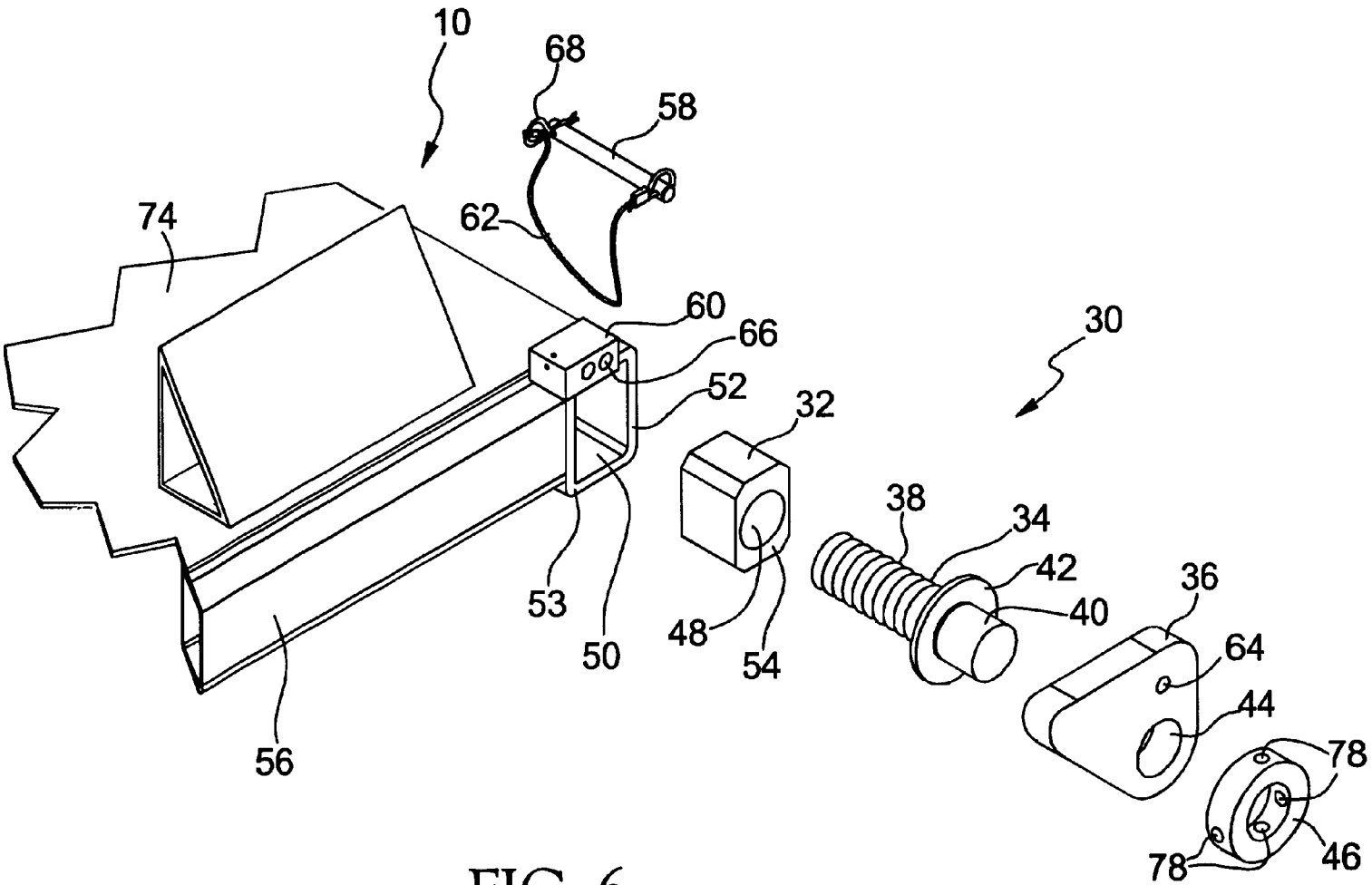
FIG. 6 is an enlarged exploded perspective view of the preferred bracing mechanism of FIG. 5.

In accordance with the invention, and as illustrated in FIGS. 5 and 6, a preferred embodiment of the present invention for securing a loading platform against at least forward movement (i.e., movement in the direction of the shipping container doors) within a shipping container includes a mounting block 32, a traversing mechanism 34, and a locking device such as cam 36. Traversing mechanism 34 is preferably an elongated rod having a threaded portion 38 and a smooth portion 40 separated by a static collar 42 welded or otherwise fixed to traversing mechanism 34. Smooth portion 40 is preferably sized and shaped to receive mounting bore 44 of cam 36 such that cam 36 is free to rotate on smooth portion 40. Adjustment collar 46 is also received on smooth portion 40 and is preferably welded or otherwise fixedly attached thereto to prevent unintended disengagement of cam 36 from traversing mechanism 34.

As depicted in FIG. 6, mounting block 32 is preferably received within passageway 50 of side beam 52 of the frame of CROP 10, and is welded or otherwise fastened thereto. Mounting block 32 is preferably offset forward of the leading edge 53 of side beam 52 a sufficient distance to provide a weld land for a fillet or other weld. This distance is minimized as much as practicable so that the overall length of bracing mechanism 30, when attached, maximizes the lateral movement of locking device 36 with respect to front beam 56 of CROP 10.

Mounting block 32 defines a threaded bore 48 that is sized and shaped to axially receive threaded portion 38 of traversing mechanism 34. When bracing mechanism 30 is not in use, traversing mechanism 34 is preferably fully rotated into engagement with mounting block 32 and cam 36 is preferably rotated and secured into a stowed position as shown in FIG. 5. Cam 36 is preferably secured in a stowed position with a locking pin 58 connected to a locking plate 60 via lanyard 62. Locking pin 58 is preferably passed through aperture 64 in cam 36 and into a first plate aperture 66 passing through locking plate 60. A hitch pin 68 also attached to lanyard 62 is fastened to locking pin 58 rearward of locking plate 60 to prevent unintended withdrawal of locking pin 58 from bracing mechanism 30. When in the stowed configuration is shown in FIG. 5, CROP 10 can be readily inserted into or withdrawn from ISO shipping container 20.

The operation of bracing mechanism 30 can be more fully described with reference to FIG. 5 and FIGS. 7–9. As depicted in FIG. 5, CROP 10 is fully inserted into ISO container 20 with bracing mechanism 30 in a stowed position. Depending upon the location of shoring slot 70 defined by inner wall 72 of ISO container 20, adjustment collar 46 is turned in a clockwise direction to rotate traversing mechanism 34 further into engagement with mounting block 32, or turned in a counter-clockwise direction to rotate traversing mechanism 34 away from mounting block 32. Adjustment collar 46 is turned until cam 36 is aligned with shoring slot 70. Locking pin 58 is then removed from aperture 64 in cam 36, and cam 36 is urged into shoring slot 70 as shown in FIGS. 7 and 8.

The various positions of use of cam 36 will now be described and defined for the preferred bracing mechanism 30 of the present invention mounted on an M3 CROP 10. To describe the various positions of cam 36, it will be understood that locking plate 60 is mounted on platform 74 of CROP 10 such that its leading edge 76 is approximately 1.130 inches from the exterior side of side rail 52. When so configured, and when cam 36 is rotated such that aperture 64 is aligned with first plate aperture 66, a line extending from the axis of rotation of cam 36 upwards through an axis passing through aligned slots 64 and 66 is the zero degree line, and cam 36 is in the "stowed position." So positioned, the top surface of cam 36 is parallel to platform 74 of CROP 10 as shown in FIG. 5. As shown in FIG. 7, cam 36 has been rotated approximately sixty-four degrees (64°) from the zero line in a clockwise direction into shoring slot 70. This is referred to herein as the "minimum use position." When cam 36 is in the minimum use position, cam 36 extends approximately 1.85 inches beyond side rail 52. As shown in FIG. 8, cam 36 has been rotated approximately ninety degrees (90°) from the zero line. This position is referred to herein as the "nominal use position." When cam 36 is in the nominal use position, cam 36 extends approximately 2.25 inches beyond side rail 52. In this position, the maximum surface area of cam 36 is received within shoring slots 70, thus providing maximum bracing for the loading platform.

Figure 7:
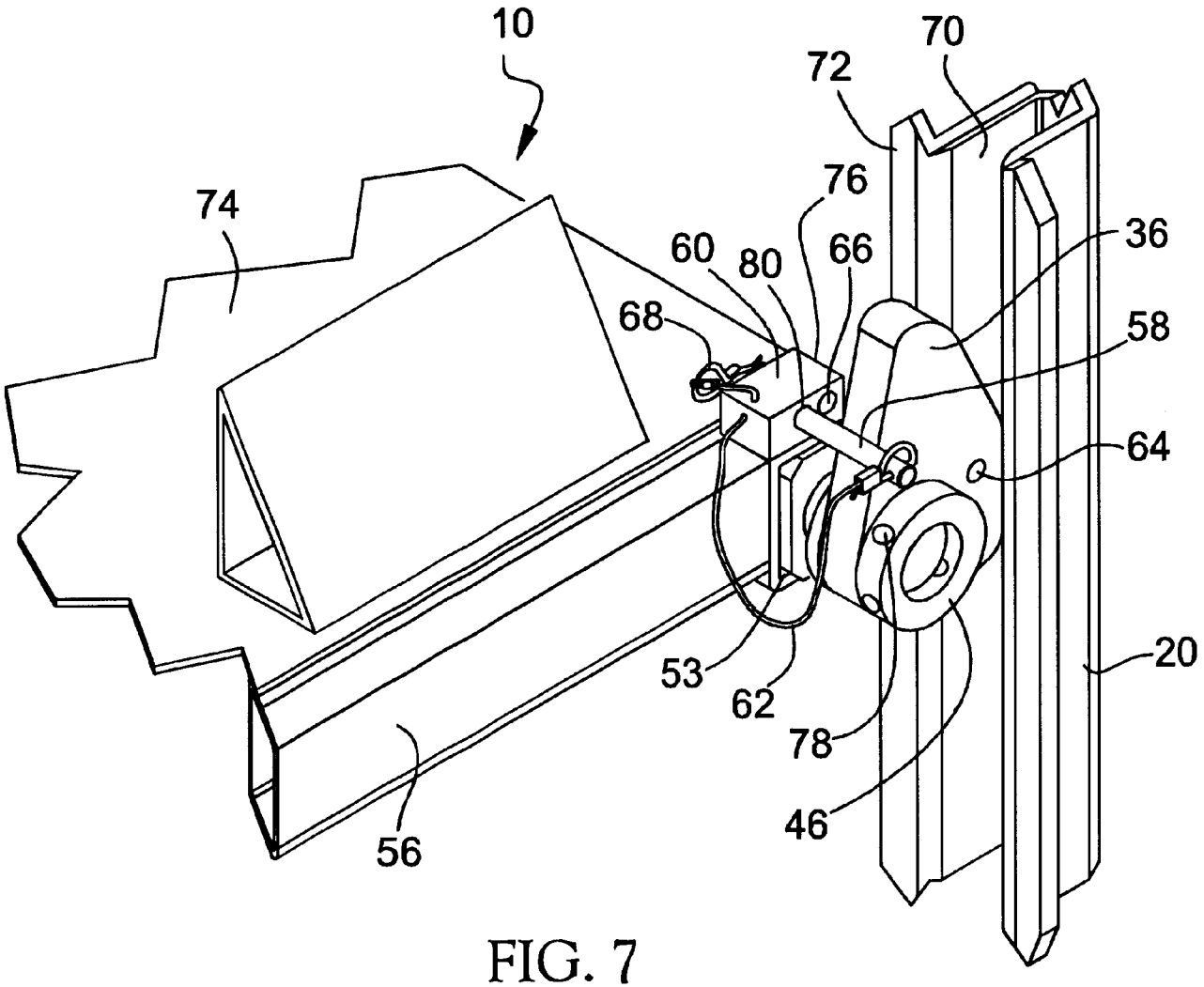
FIG. 7 is an enlarged partial perspective view of the preferred bracing mechanism of FIG. 5 depicting the minimum use position.
Figure 8:
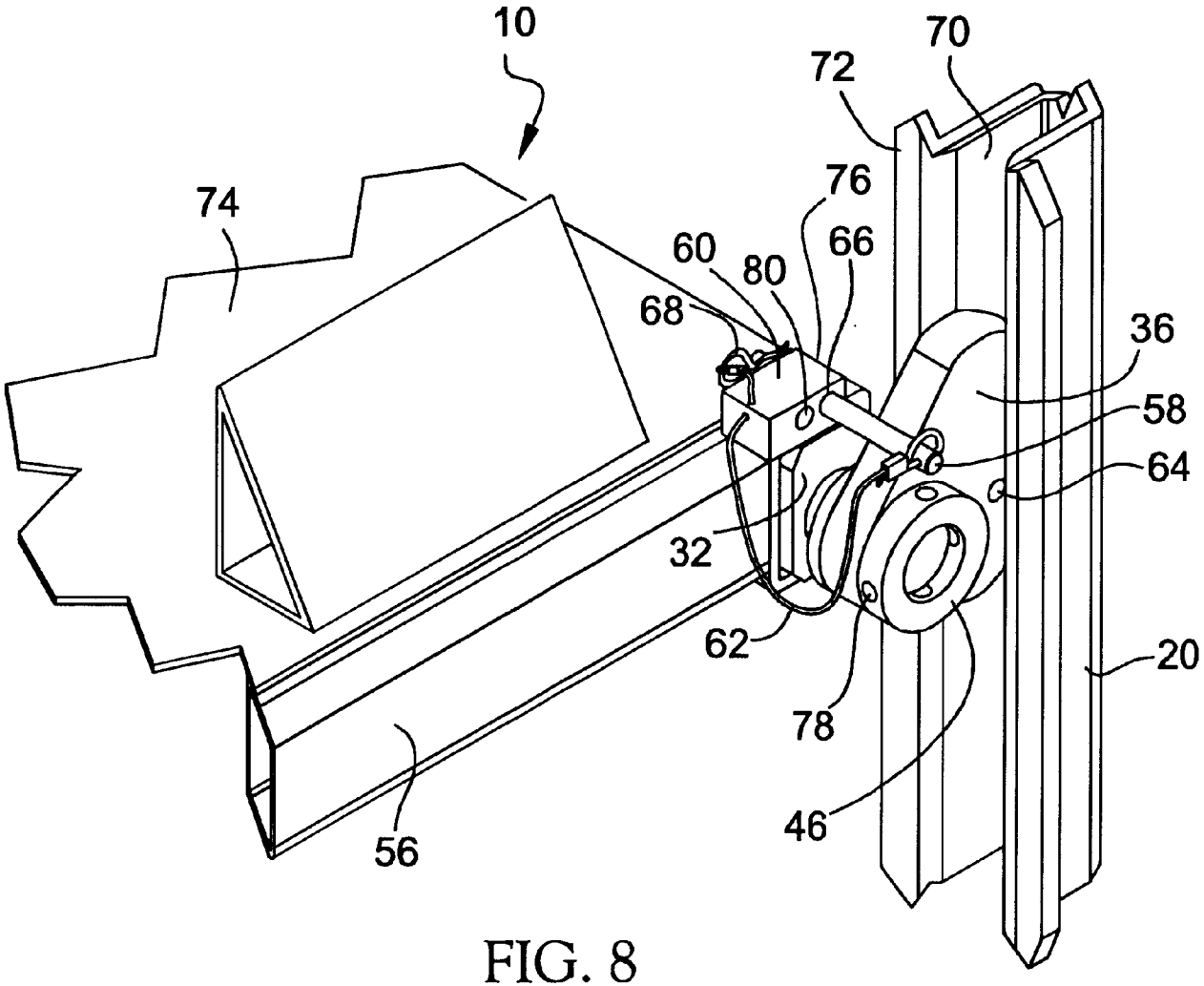
FIG. 8 is an enlarged partial perspective view of the preferred bracing mechanism of FIG. 5 depicting the nominal use position.
Figure 9:
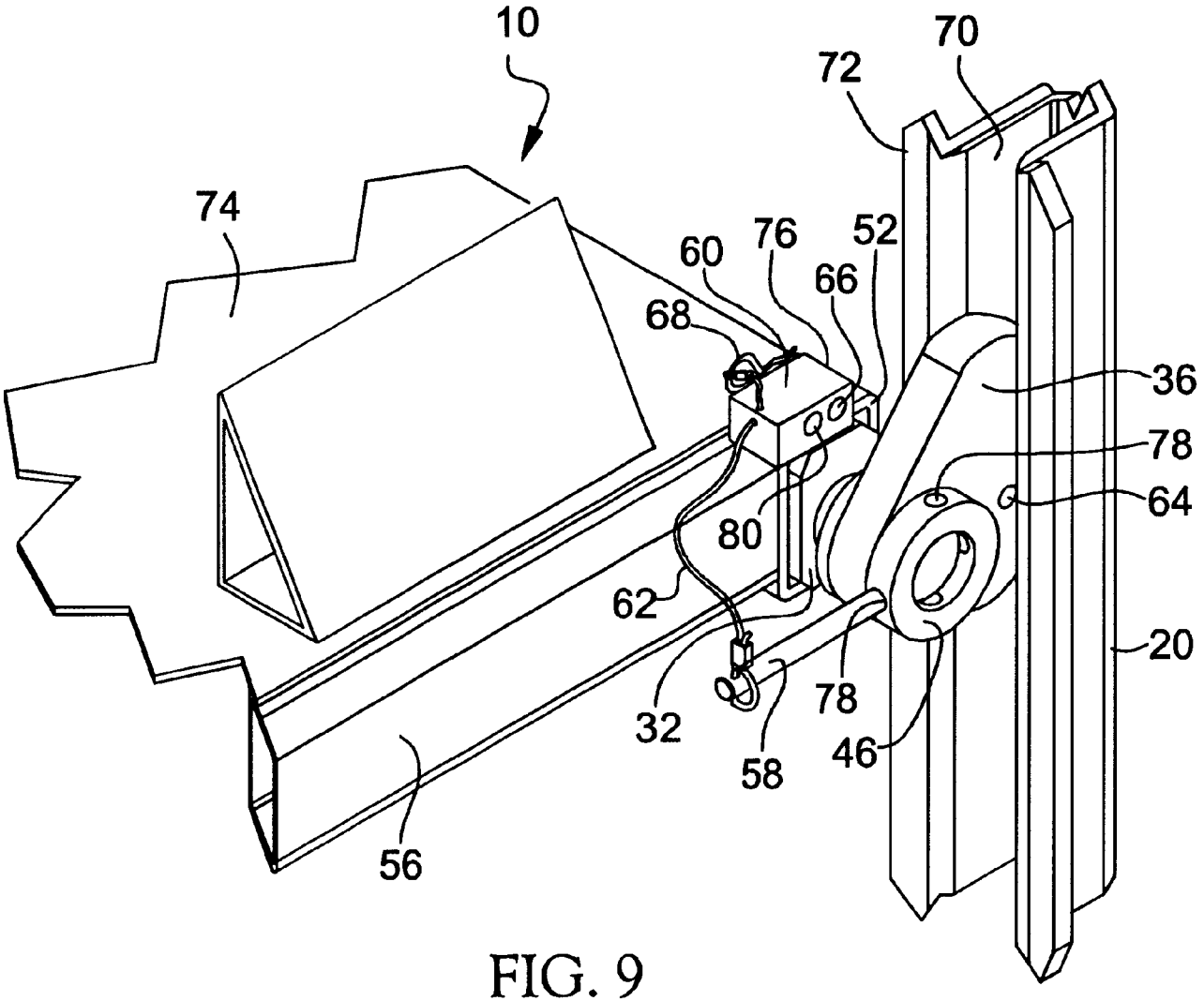
FIG. 9 is an enlarged partial perspective view of the preferred bracing mechanism of FIG. 5 depicting the tightening function of the locking pin in accordance with the present invention.

As shown in FIG. 7, if CROP 10 is not properly centered within ISO container 20 when loaded, it may be necessary to rotate cam 36 into the minimum use position, as shoring slot 70 may be insufficiently deep to permit cam 36 to fully rotate into the nominal use position. If however, as shown in FIG. 8, CROP 10 is properly centered within ISO container 20, cam 36 is preferably fully rotated to the nominal use position. In either event, and as depicted in FIG. 9, locking pin 58 is preferably inserted into one of a plurality of collar apertures 78 spaced along the periphery of adjustment collar 46 to facilitate rotation of adjustment collar 46, and thus adjustment of traversing mechanism 34, to urge cam 36 snugly against one of the shoring slot 70 sidewalls as shown in FIG. 9. Preferably, cam 36 is urged toward the forward sidewall (i.e., the sidewall closest the shipping container doors).

If cam 36 is moved into the minimum use position as shown in FIG. 7, after tightening, locking pin 58 is preferably inserted into second plate aperture 80 to prevent cam 36 disengagement from shoring slot 70. Following insertion, hitch pin 68 is preferably fastened to locking pin 58 to prevent separation of locking pin 58 from locking plate 60. If, however, cam 36 is urged into the nominal use position as shown in FIG. 8, following tightening, locking pin 58 is preferably inserted into first plate aperture 66 in locking plate 60, and hitch pin 68 is thereafter attached to locking pin 58 to prevent cam 36 disengagement from shoring slot 70.

It will be understood by those skilled in the art that it is preferable to employ a second bracing mechanism 30 forward of the second side rail of CROP 10 in accordance with the detailed description set forth above when bracing a CROP 10 within an ISO container. Generally speaking, in such an arrangement, it is preferable to tighten each cam 36 against the forward sidewall of shoring slot 70. In this way, CROP 10 is braced against movement in the forward direction within ISO container 20 by bracing mechanisms 30, and against movement in the rearward direction (i.e., away from the ISO container doors) by frame mounted bumpers (not shown) affixed to CROP 10. For those shipping containers not employing rear bumpers, it may be necessary to tighten each cam 36 in opposite directions so that first cam 36 is snug against the forward sidewall of shoring slot 70, and second cam 36 is snug against the rear sidewall of the other shoring slot 70. In this way, CROP 10 is at least braced against significant movement in the rearward direction within ISO container 20 as well. Although bracing mechanisms 30 provide some amount of frictional resistance against movement of CROP 10 in a vertical direction, it will be appreciated that the primary force inhibiting motion in a vertical direction is the weight of CROP 10 and its load.

It will be apparent to those skilled in the art that various modifications and variations can be made to the present invention without departing from the spirit and scope of the invention. For instance, bracing mechanism 30 could incorporate a hydraulic or pneumatic traversing mechanism rather than the threaded traversing mechanism described above. Moreover, locking plate 60 could incorporate additional plate apertures to facilitate additional locking positions depending upon, at least in part, the shape of the cam 36 or other locking device selected. Further, although locking pin 58 is preferably manufactured from corrosion resistant, ½ inch diameter bar stock in accordance with AISI 630 (UNS S17400/PH17-4), and is heat treated to H1150 condition having a Rockwell C-hardness range of between about 31 to 35, locking pin 58 could be made of other sufficiently rigid materials in accordance with other specifications. Moreover, although cam 36 is preferably of high strength low alloy steel construction approximately 1¼ inches in thickness in accordance with ASTM A572 grade 50, cam 36 could be made of other sufficiently rigid materials in accordance with other specifications. Thus, it is intended that the present invention cover the modifications and variations of this invention provided they come within the scope of the appended claims and their equivalents.

What is claimed is:

1. A loading platform and an apparatus for securing a loading platform, said apparatus comprising:

a mounting block connected to the loading platform;

a traversing mechanism including a threaded rod rotatably received into and extendable from said mounting block, said threaded rod coupled at one of its ends to said mounting block and having a finite length; and a locking device mounted adjacent the end of said traversing mechanism remote from said mounting block and being infinitely adjustable laterally of said mounting block over at least a portion of the length of said traversing mechanism, said locking device constructed and arranged to be selectively urged into and out of a position of use.

2. The apparatus of claim 1 further comprising a collar mounted on the end of said traversing mechanism remote from said mounting block such that said locking device is positioned therebetween, said collar defining at least one bore for facilitating adjustment of said traversing mechanism.

3. A loading platform and an apparatus for securing a loading platform, said apparatus comprising:

a mounting block connected to the loading platform;

a traversing mechanism coupled at one of its ends to said mounting block, said traversing mechanism having a finite length; and a locking device mounted adjacent the end of said traversing mechanism remote from said mounting block, said locking device constructed and arranged to be selectively moved into and out of a position of use and being infinitely adjustable laterally of said mounting block over at least a portion of the length of said traversing mechanism, wherein said locking device includes a cam, said cam being freely rotatable about said traversing mechanism and received on said traversing mechanism such that it is movable into at least one locking position and at least one stowed position.

4. The apparatus of claim 3 further comprising a cam locking plate having at least one orifice, and a cam locking pin sized and shaped to be slidably received within said at least one locking plate orifice to selectively secure said cam into the at least one locking position and the at least one stowed position.

5. The apparatus of claim 4 wherein said locking plate includes a plurality of orifices.

6. A loading platform and an apparatus for securing a loading platform, said apparatus comprising:

a mounting block connected to the loading platform;

a traversing mechanism coupled at one of its ends to said mounting block, said traversing mechanism having a finite length; and a locking device mounted adjacent the end of said traversing mechanism remote from said mounting block, said locking device constructed and arranged to be selectively moved into and out of a position of use and being infinitely adjustable laterally of said mounting block over at least a portion of the length of said traversing mechanism wherein said mounting block is slidably received into and fixedly connected to a frame member of the loading platform.

7. A method of bracing a loading platform in a shipping container, said method comprising the steps of:

securing a mounting block having a passageway passing therethrough on the loading platform;

inserting a first end of a traversing mechanism axially into the passageway, said traversing mechanism including a threaded rod having a finite length and being infinitely adjustable over at least a portion of that length;

mounting a locking device on a second end of said traversing mechanism, said locking device moveable between a stowed position and a position of use;

moving said traversing mechanism axially with said locking device in the stowed position to properly position said locking device with respect to the shipping container, said moving step including the step of rotating said threaded rod to incrementally adjust the position of said locking device; and urging said locking device into a position of use, whereby said locking device engages the shipping container to prevent at least forward movement of the loading platform with respect to the shipping container.

8. The method of claim 7 further comprising the step of securing said locking device in said position of use.

9. A method of bracing a loading platform in a shipping container, said method comprising the steps of:

securing a mounting block having a passageway passing therethrough on the loading platform;

inserting a first end of a traversing mechanism axially into the passageway;

mounting a cam on a second end of said traversing mechanism, said cam being freely rotatable about said traversing mechanism;

moving said traversing mechanism axially with said cam in a stowed position to properly position said cam with respect to the shipping container; and rotating said cam into at least a position of minimal use, whereby said cam engages the shipping container to prevent at least forward movement of the loading platform with respect to the shipping container.

10. A method of bracing a loading platform for shipment, said method comprising the steps of:

a) moving a locking device to a stowed position, said locking device attached to a bracing mechanism mounted on the loading platform, said bracing mechanism including a traversing mechanism having a finite length and being infinitely adjustable over at least a portion of its length and having a securing device;

b) urging the loading platform into a shipping container having at least one shoring slot;

c) adjusting said traversing mechanism to align said locking device with the shoring slot;

d) extending said locking device to a position of use such that said locking device mates with the shoring slot; and e) positioning the securing device with respect to said locking device such that unintended separation of said locking device from the shoring slot is prevented.

11. The method of claim 10 wherein said securing device comprises a locking plate and a locking pin, the method further comprising the step of mating the locking pin with the locking plate such that the locking pin is positioned in the rotation path of said locking plate.

12. A method of bracing a loading platform for shipment, said method comprising the steps of:

a) moving a locking device to a stowed position, said locking device attached to a traversing mechanism comprising an elongated threaded rod having a finite length and being infinitely adjustable over at least a portion of its length and a mounting block attached to the loading platform, said mounting block defining a threaded bore sized and shaped to receive said threaded rod;

b) urging the loading platform into a shipping container having at least one shoring slot;

c) rotating said threaded rod with respect to said mounting block to incrementally adjust the distance between said locking device and the loading platform to align said locking device with the shoring; and d) extending said locking device to a position of use such that said locking device mates with the shoring slot.

* * * * *